United States Patent [19]

Valentine et al.

[11] 3,946,665

[45] Mar. 30, 1976

[54] APPARATUS FOR POSITIONING A ROTATABLE INDICIA CARRYING MEMBER

[75] Inventors: Richard E. Valentine, Mentor; Norman R. Avery, Chesterland, both of Ohio

[73] Assignee: Addressograph-Multigraph Corporation, Cleveland, Ohio

[22] Filed: June 28, 1974

[21] Appl. No.: 484,089

[52] U.S. Cl. ..... 101/45; 101/110; 101/56

[51] Int. Cl.[2] ..... B41J 1/32

[58] Field of Search ..... 101/45, 209–274, 101/56, 110, 95, 36, 96

[56] References Cited

UNITED STATES PATENTS

| | | | |
|---|---|---|---|
| 3,138,091 | 6/1964 | Maul | 101/45 |
| 3,279,369 | 10/1966 | Wight | 101/110 X |
| 3,363,547 | 1/1968 | Thut et al. | 101/45 |
| 3,732,812 | 5/1973 | Brenner | 101/99 |
| 3,776,130 | 12/1973 | Tamiya | 101/56 X |

*Primary Examiner*—Clyde I. Coughenour
*Assistant Examiner*—Edward M. Coven
*Attorney, Agent, or Firm*—Harry M. Fleck, Jr.

[57] ABSTRACT

An improved mechanism for properly aligning a rotatable indicia carrying member and for locking said rotatable indicia carrying member in place. Both the aligning and locking mechanisms are formed as integral parts of a single frame unit and are operative to perform their respective aligning and locking functions during movement of the frame unit into engagement with the rotatable member.

20 Claims, 8 Drawing Figures

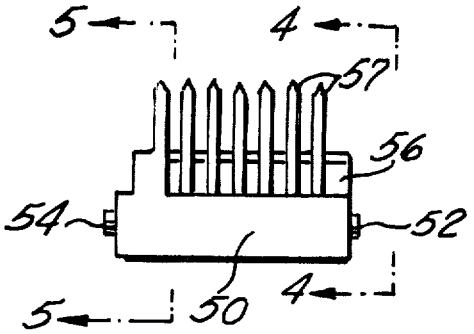
FIG. 3
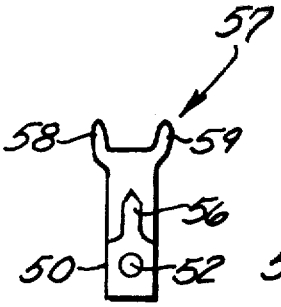
FIG. 4
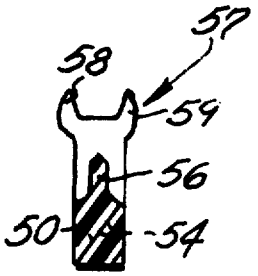
FIG. 5
FIG. 6
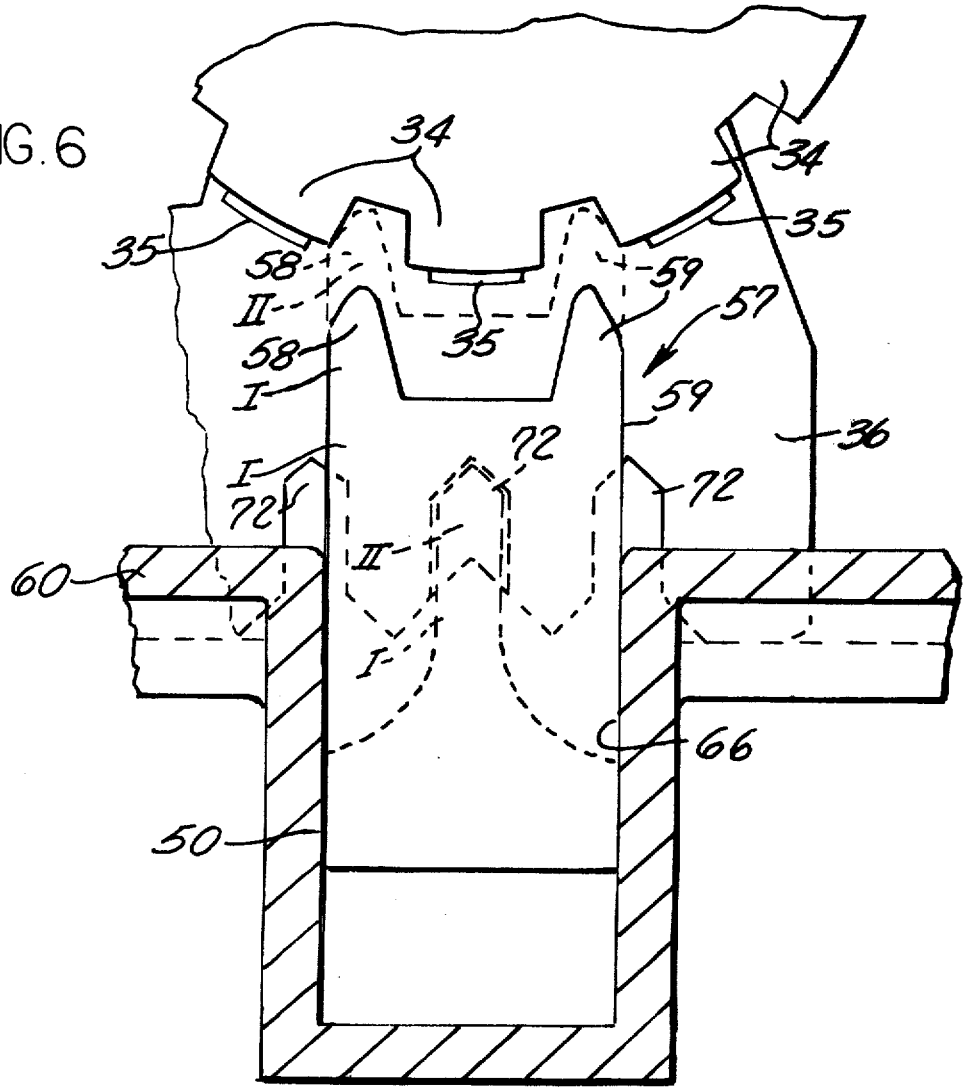

APPARATUS FOR POSITIONING A ROTATABLE INDICIA CARRYING MEMBER

BACKGROUND OF THE INVENTION

The present invention relates to a locking mechanism for systems employing rotatable indicia carrying members. It has particular application in systems in which rotatable indicia carrying members are used for printing purposes, such as data recorders and particularly credit card bill printing devices. It is important in such devices that the rotatable indicia carrying members be positioned so that the desired indicia is accurately aligned with the appropriate spaces on a bill manifold. Also, during the actual printing operation, which usually involves a reciprocating platen which applies pressure to both the bill manifold and the indicia carrying member, it is important that the rotatable indicia carrying member be rigidly locked against movement, so that it does not blur the printed image.

In providing a mechanism for aligning and locking rotatable indicia carrying members, known prior art devices have utilized relatively complex mechanical linkages having numerous parts. The linkages have been designed so that the aligning and the locking functions are each effected through individual movements of their respective members, which movements are then coordinated by appropriate linkages. With linkages involving many relatively moving parts, it becomes often necessary to check the alignment of the parts themselves so that their own registration, and their respective coordination, will be proper.

SUMMARY OF THE PRESENT INVENTION

According to the present invention, an aligning and locking mechanism is provided for a rotatable indicia carrying member, and includes both aligning means and locking elements formed integrally with a single movable frame member. The frame member is adapted to move between a retracted position and a locking position and the aligning and locking mechanism is designed so that, upon movement of the frame toward the locking position, the aligning elements engage the mechanism which rotates the indicia carrying member in such a manner so as to correctly align the rotatable member in a desired position. Upon further movement of the frame to a locking position, the locking elements engage the indicia carrying member and lock it against rotational movement.

It is thus the principal object of the present invention to provide a locking mechanism for a rotatable indicia carrying member, which locking mechanism is made up of few moving parts and yet is capable of precisely aligning and effectively locking said member in a desired position.

DESCRIPTION OF THE DRAWINGS

Other objects and advantages of the present invention will be further apparent from the following description and the accompanying drawings wherein:

FIG. 3 is a view of one side of the aligning and locking mechanism in accordance with the present invention;

FIG. 4 is an end view of the right side of the mechanism shown in FIG. 3 taken substantially along line 4—4 thereof;

FIG. 5 is a sectional view taken substantially along the line 5—5 of FIG. 3;

FIG. 6 is a schematic sectional representation of the aligning and locking mechanism of the present invention and illustrating various positions of the aligning and locking mechanism.

DESCRIPTION OF AN EMBODIMENT OF THE PRESENT INVENTION

As stated above, the present invention relates to an aligning and locking mechanism for an indicia carrying rotatable member. By way of example, and for the purposes of explanation, the aligning and locking mechanism of the present invention is disclosed in combination with a rotatable indicia carrying member forming part of a data recorder, such as used for credit card bill printing.

Figure 1:
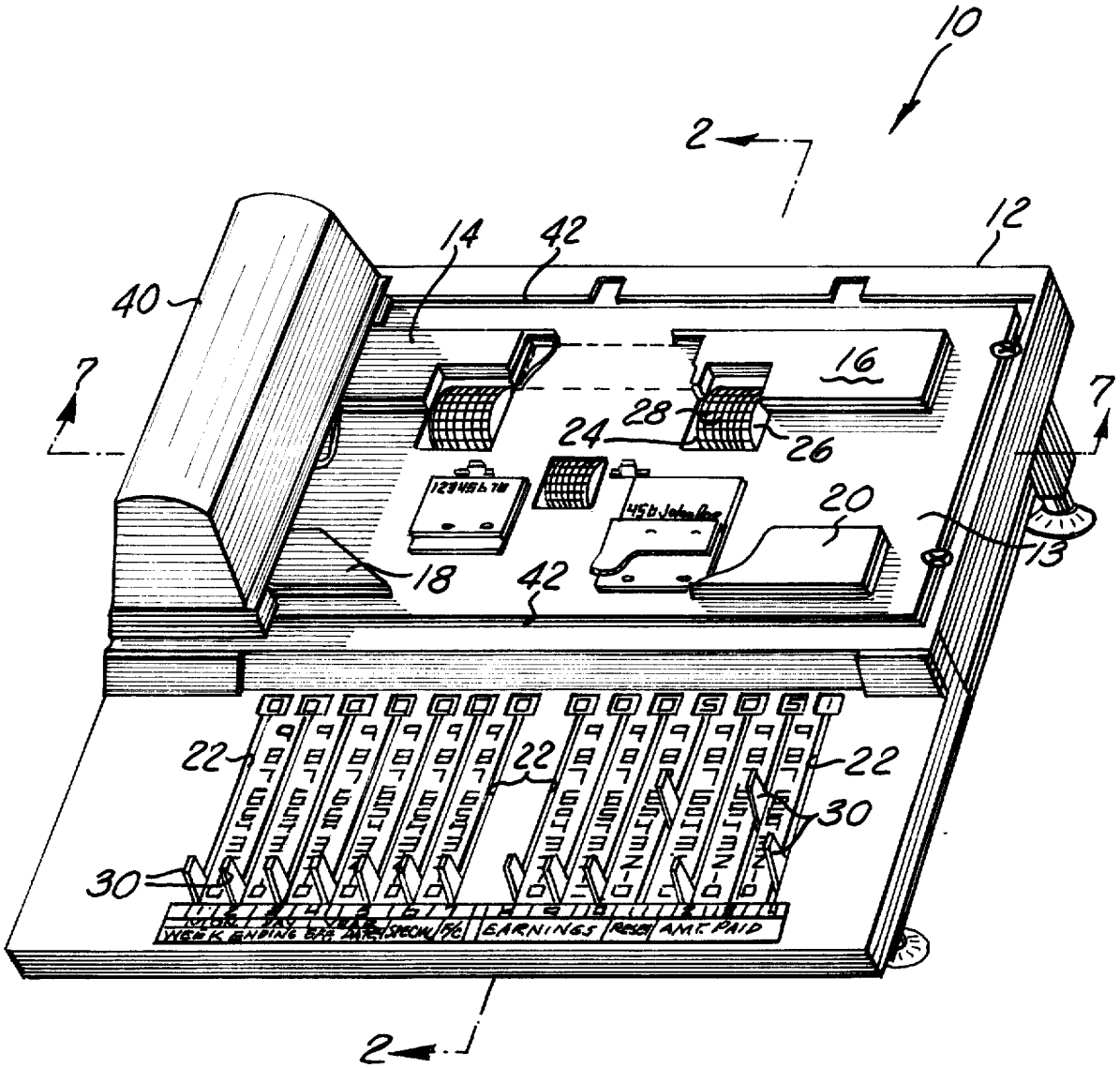
FIG. 1 discloses a perspective view of a typical data recorder employing the present invention.

Referring to FIG. 1, a credit card bill printing apparatus is represented generally by the numeral 10. The printing apparatus includes frame 12, having an upper surface 13 which includes suitable detents to provide for accurate positioning of both credit card and bill manifolds on the bed or bill printing frame. Such detents may, for example, take the form represented by the numerals 14, 16, 18 and 20 in FIG. 1, or they may take any other suitable form for retaining both credit card and bill manifold in proper position upon the surface 13. They are well-known and need not be further described.

The frame 10 also includes a plurality of parallel slots 22 and at least one code wheel opening 24 through which the upper portions of a code wheel assembly 26 project. The code wheel assembly 26 includes a plurality of digit carrying wheels 28, and each digit carrying wheel has one of the parallel slots 22 associated therewith. Tabs 30 which project through slots 22 are suitably connected to their respective digit carrying wheels 28 by mechanism to be described hereinafter, and the mechanism is suitably calibrated so that positioning of a tab adjacent a particular numeral along its respective slot serves to position a respective digit carrying wheel with its digit corresponding to the selected numeral projecting through slot 24 and in printing position.

Figure 2:
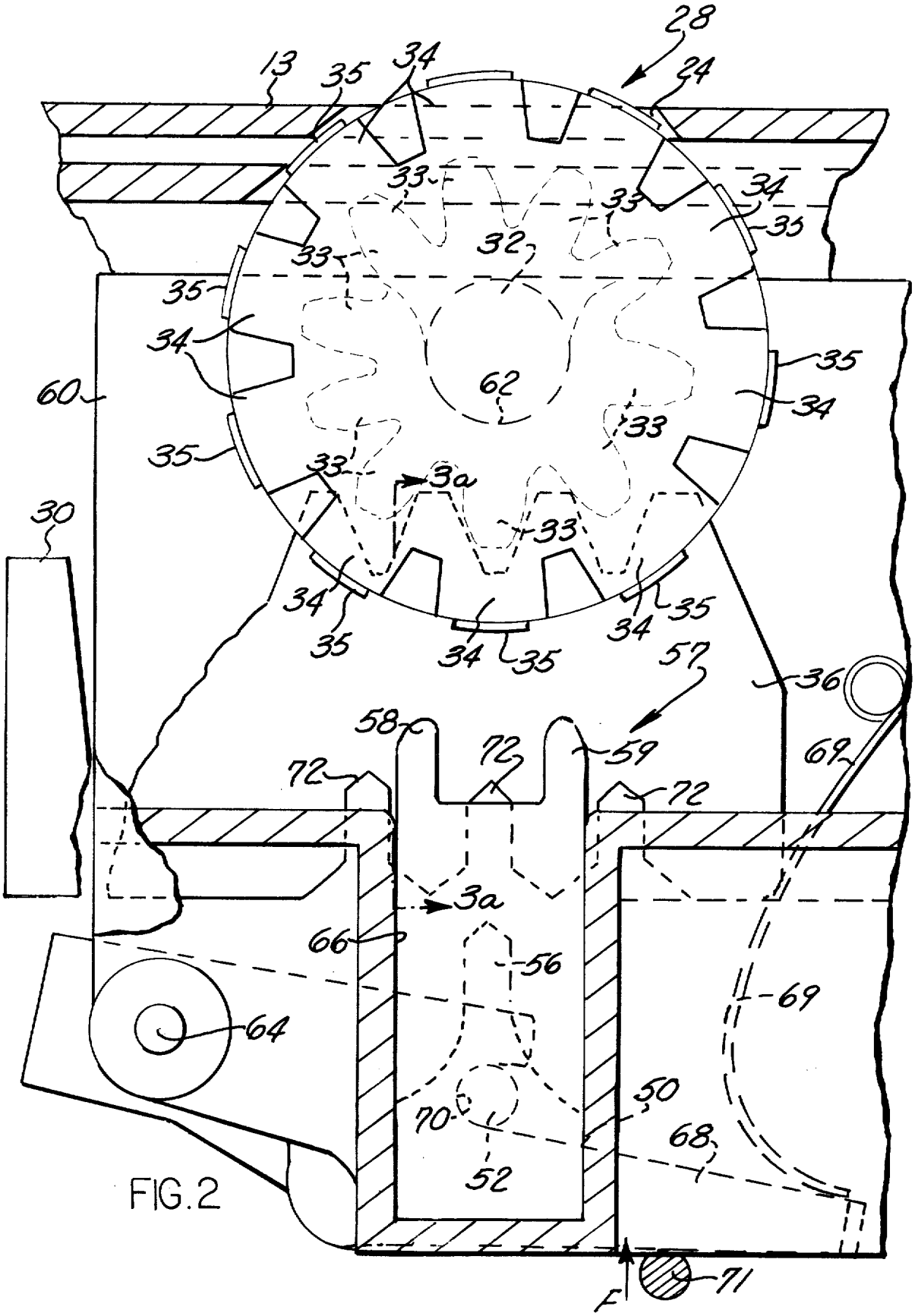
FIG. 2 is a fragmentary sectional view taken generally along line 2—2 looking in the direction of the arrows of FIG. 1.

The overall makeup of the mechanism which positions a digit carrying wheel in accordance with the setting of a respective tab may be understood by reference to FIG. 2. Each wheel 28 is rotatably mounted on a single main shaft 32 and is formed as a toothed member 34 with a separate digit 35 carried by each tooth of the member 34. Each wheel 28 shown in FIG. 2 includes a pinion gear 33 integral therewith. Tab 30 is connected to a rack 36 which is mounted for linear reciprocating movement, and includes teeth 38 which are adapted to engage the teeth of the pinion gear 33 to rotate the digit carrying wheel 28. Rack 36 can thus rotate its respective digit carrying wheel in either a clockwise or counterclockwise direction to position the digit carrying wheel with a desired digit protruding through opening 24 in the frame and thereby roughly in position for printing on a credit card bill manifold.

While digit carrying wheel 28 is disclosed above as being formed with pinion 33 for engaging the rack it is contemplated that the rack 36 could be adapted to directly engage the toothed member 34 to rotate the digits 35. In such a case it is merely necessary that the toothed member 34 be of sufficient thickness so that it can be simultaneously engaged by both the rack teeth and the locking pawl to be described hereinafter. It is also contemplated that wheels 28 be rotated by a member other than a rack, such as another gear, for example. Further, the mechanism which rotates the wheel (i.e. rack, gear, etc.) could be motor driven as well as manually operated.

Referring again to FIG. 1, the printing process is actuated by movement of a platen carriage 40 over a credit card and bill manifold which are supported on the top surface 13 of the frame 10. Slots 42, 44 permit passage of suitable links (not shown) which are connected to the platen carriage 40 and help to guide the platen carriage along a substantially linear path.

When the tabs 30 are set to a desired numeral, suitable detents (not shown but well known in the art) help to roughly index the racks so that a rough positioning of the digit carrying wheel in a desired position is accomplished. However, upon actuation of the platen, it is important that a precise alignment of the digit carrying wheel be effected so as to assure that the selected digit is in printing position despite any inaccuracy which may take place in the location of a tab adjacent a respective numeral (particularly during an operator's haste to complete a sale). Also, even if the rough aligning is proper, it is also desirable to lock the digit carrying wheels against rotational movement as the platen passes thereover.

Figure 3A:
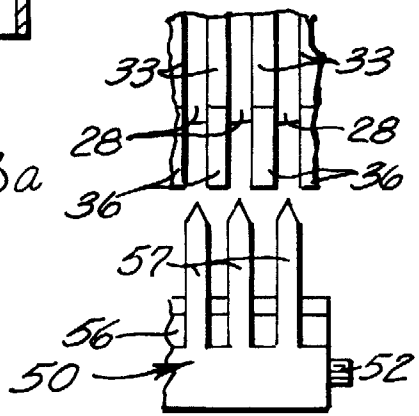
FIG. 3*a* is a fragmentary sectional view taken generally along the line 3*a*—3*a* of FIG. 2, with parts omitted, and illustrating the orientation of the aligning and locking mechanism relative to the indicia carrying members and to the means which rotate the indicia carrying members.

The present invention provides a single aligning and locking mechanism which has both alignment means and locking means as integral parts thereof. The aligning and locking mechanism is shown in FIGS. 3, 3*a*, 4 and 5, and includes a support frame 50 having a pair of driving pins 52, 54 at the ends thereof. A plurality of aligning pawls 56 extend outwardly from the frame member 50. A plurality of locking pawls 57 also extend outwardly from frame member 50. As seen in FIG. 3, the alignment pawls and locking pawls are alternatively located along the length of the frame member, and the locking pawls 57 extend further outwardly from the frame than do the alignment pawls 56. Also, as clearly seen from FIGS. 4 and 5, the preferred construction of each of the locking pawls is that of a tooth-shaped member having a pair of protrusions 58, 59, each of which includes a pair of converging surfaces.

Referring now to FIGS. 2, 3*a* and 6, the salient features of the actuating mechanism for the aligning and locking mechanism will be more fully explained. Fixedly supported on the underside of the frame 10 is a variable unit frame 60. The frame 60 includes a semicircular opening 62 which receives the main shaft 32 that supports the digit carrying wheels 28. The lower portion of the variable unit frame 60 includes suitable holes which receive a support shaft 64. A recess 66 is found in frame 60 and is contoured with a cross section similar to that of the frame 50 of the aligning and locking mechanism. Also, the frame member 50 is received in the correspondingly shaped recess 66. The actuating mechanism also includes a bracket 68, the end of which is pivotally mounted to support shaft 64. Bracket 68 includes a slot 70 through which the driving pins 52, 54 of the aligning and locking mechanism extend.

When assembled as described heretofore, it should be obvious that when the bracket means is rotated about shaft 64, this pivotal movement actuates the aligning and locking mechanism frame 50 and drives it in a linear direction either toward or away from the digit carrying wheel 28.

As further seen from FIG. 6, the rack includes a plurality of recesses 72 which taper outwardly toward their bottom portions. The recesses 72 are so dimensioned and located so that the width of the tapered bottom portion of each such recess approximates the arc distance between corresponding points of adjacent teeth of the digit carrying wheel.

The aligning and locking functions of the aligning and locking mechanism are required while the printing platen carriage 40 traverses the frame top. Preferably, this is achieved in response to movement of the platen carriage by a suitable linkage between the platen carriage and the bracket. Such linkage serves to translate left to right movement of the platen carriage (as shown in FIG. 1) in appropriate movement of a bracket actuating mechanism which applies an upwardly directed force, shown by the vector $\vec{F}$ in FIG. 2. The carriage movement pivots the bracket 68 counterclockwise and, in turn, urges the aligning and locking mechanism in an upward direction toward the locking position.

Figure 7:
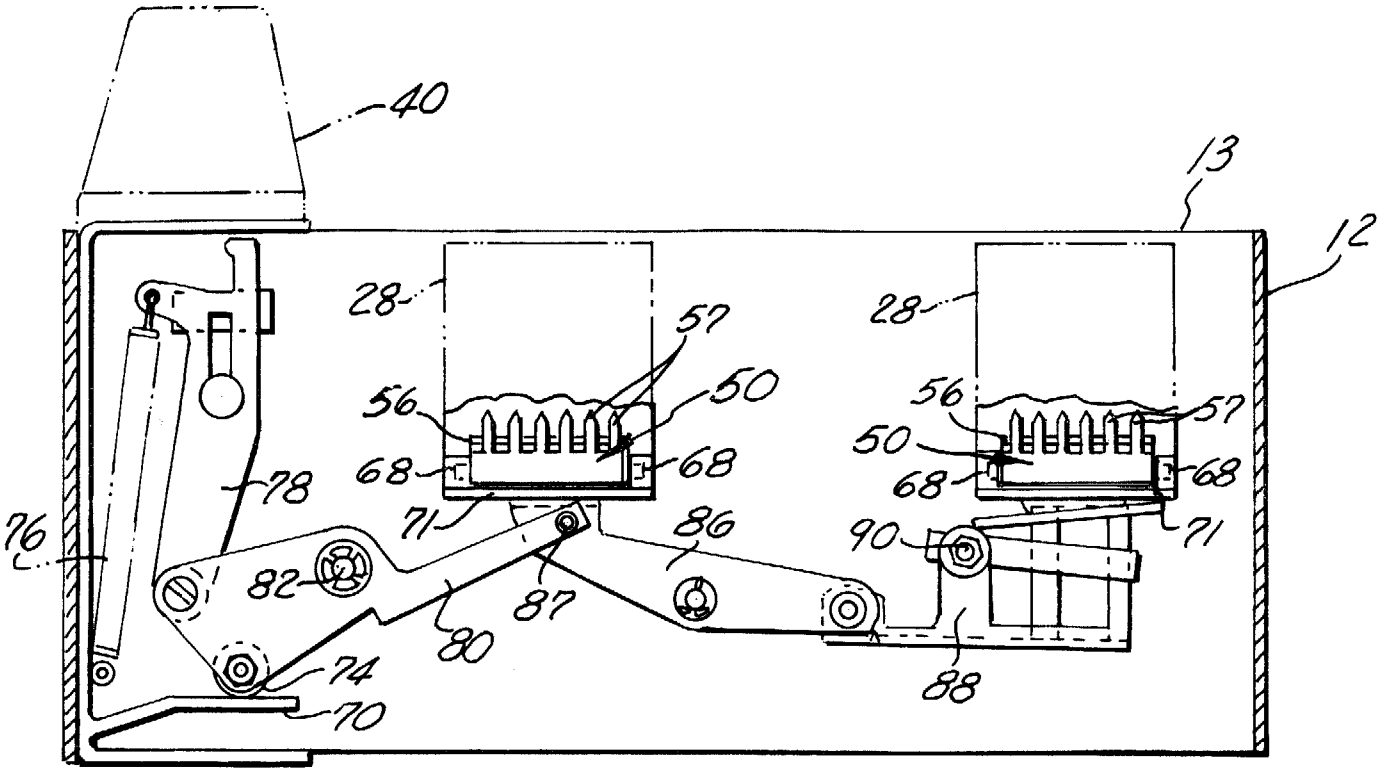
FIG. 7 is a sectional view along line 7—7 of FIG. 1, with parts omitted, and illustrating a suitable linkage for actuating an aligning and locking mechanism of the present invention.

In FIG. 2 the numeral 71 represents a sectional view of a bracket actuating member which, upon application of the force $\vec{F}$, is urged upwardly against the bias of leaf spring 69. It is contemplated that numerous conventional types of linkages may be used to pivot the bracket in either the clockwise or counterclockwise direction. As a specific example, a suitable linkage for such purposes may be appreciated by reference to FIG. 7. Platen carriage 40 has cam 70 suitably attached thereto. Upon movement of carriage 40 to the right (viewing FIGS. 1 and 7) cam 70 moves away from cam follower 74, and spring 76 acts through slider link 78 to pivot lever 80 counterclockwise about pivot point 82. Pivoting of lever 80 also pivots levers 86, 88 with lever 88 being pivoted counterclockwise about pivot point 90. Levers 80 and 88 each have an actuating member 71 connected thereto. Counterclockwise pivoting of the levers 80 and 88 urge their respective members 71 in an upward direction, thereby pivoting the brackets 68 counterclockwise in a manner set forth heretofore. It should be remembered that the foregoing is merely illustrative of a suitable linkage for urging said aligning and locking member toward its aligning and locking positions. It is contemplated that numerous conventional linkages would also be suitable.

Referring now to FIG. 3*a*, it will be clear that the locking pawls 57, which are spaced along frame 50, are aligned with code wheels 28. Racks 36 are aligned with the spaces between the locking pawls and with the pinions 33. The alignment pawls 56 are thus aligned with the racks 36 and the spaced locking pawls are thus oriented to travel between the racks. Thus, with the bottom taper of the recess dimensioned as set forth heretofore the upper movement of the aligning and locking member assures that as an aligning pawl enters a respective recess 72 it will act as a camming member and serve to shift the rack and the digit carrying wheel associated therewith, if necessary, so that so long as the tab is not offset from a desired digit by more than half the distance between adjacent digits, the alignment pawl positions the rack and the digit carrying wheel properly.

After the alignment pawl enters and moves along the recess 72 in the rack and thereby correctly positions the digit wheel, the locking pawl, and particularly the protrusions 56, 58 enter a pair of respective slots on either side of a tooth 34 of the digit carrying wheel with their outer converging surfaces engaging respective surfaces of a pair of teeth 34. Each locking pawl thereby exerts oppositely directed forces on the digit carrying wheel teeth, and thereby locks the digit carrying wheel against rotational movement.

FIG. 2 shows the restracted or non-locking position of the aligning and locking mechanism. In FIG. 6 the solid line position labeled I represents the position of the aligning and locking mechanism in its aligning position. The dotted line position labeled II illustrates the position of the aligning and locking mechanism in its locking position.

The aligning and locking mechanism of the present invention is preferably formed as a single molded member. As can be seen from FIG. 6, the spacing between the top of the alignment pawl, the top of the locking pawl, and the depth of the rack recess are such that the locking pawl will make contact with the digit wheel teeth before the top of the alignment pawl makes contact with the rack recess. This assures that the alignment pawl will not interfere with the proper functioning of the locking pawl. Also, with the lateral dimensions of the aligning pawls 56 being fairly close to those of the rack recess 72, the aligning pawl serves to lock the rack against any significant movement. This, however, does not necessarily lock the wheels due to the inherent slack between the rack teeth and the pinion gear 33. Positive locking of the wheels, of course, is assured by the locking pawls 57 which engage wheel 28 and apply equal and opposite moments thereto.

The locking mechanism as described heretofore thus includes both alignment pawls and locking pawls which are integral therewith. This design permits the aligning and locking mechanism to be formed as a single molded member. It is contemplated, moreover, that the connection of either the alignment or locking pawl to the frame could be accomplished through a lost motion connection with the frame, so long as the alignment pawl does not interfere with the locking action of the locking member.

Also, when the present invention is employed in combination with a data recorder for credit card bill printing or the like, there are numerous features of such data recorders which are known in the data recording art and which may be further incorporated into such recorders without departing from the spirit or basic structure of the present invention.

Moreover, while described in its preferred embodiment in combination with a data recorder for credit card printing it is contemplated that a locking mechanism of the type set forth above may be used with various other types of devices wherein precise positioning and locking of a rotatable indicia displaying member may be desirable.

Having described the invention, what is claimed is:

1. Apparatus for positioning a rotatable indicia carrying member in a desired position, said apparatus comprising means for rotating said indicia carrying member about an axis to a first position which is at least close to the desired position, an aligning and locking mechanism including a frame and means for moving said frame between a retracted position and a locking position, aligning means rigidly attached to said frame and responsive to movement of said frame toward said locking position to engage and actuate said means for rotating said indicia carrying member so as to position said indicia carrying member in said desired position, and locking means rigidly attached to said frame and operative subsequent to operation of said aligning means when said frame is in said locking position to retentively engage and lock the indicia carrying member against rotational movement.

2. Apparatus as set forth in claim 1 wherein said means for rotating the indicia carrying member comprises a rack.

3. Apparatus as set forth in claim 2 wherein said rack includes means defining at least one recess and said aligning means includes a first pawl means movable into said recess.

4. Apparatus as set forth in claim 3 wherein said locking means includes a second pawl means which, when said frame is moved to said locking position, retentively engages said indicia carrying member.

5. Apparatus as set forth in claim 4 wherein said indicia carrying member includes a plurality of locking teeth, at least one of which is retentively engaged by said second pawl means when said frame is moved to said locking position.

6. Apparatus as set forth in claim 5 wherein said means for moving said aligning and locking mechanism comprises a printing platen.

7. Apparatus as set forth in claim 1 including a plurality of said rotating means and a corresponding plurality of said rotatable indicia carrying members which are rotatable about said axis.

8. Apparatus as set forth in claim 7 wherein said aligning means includes a plurality of spaced first pawls integral with said frame and said locking means includes a plurality of spaced second pawls integral with said frame, said first pawls and said second pawls being alternately spaced along said frame, each of said first pawls operatively engaging a respective one of said rotating means when said frame is moved toward said locking position to position its respective one of said indicia carrying members in a desired position, each of said second pawls operatively engaging a respective indicia carrying member to lock such against rotational movement upon movement of said frame to said locking position.

9. Apparatus as set forth in claim 8 wherein said means for rotating said indicia carrying members includes a plurality of spaced racks each of which is operatively connected with a respective one of said indicia carrying members and is individually actuatable to rotate its said respective one of said indicia carrying members.

10. Apparatus as set forth in claim 9 wherein said means for moving said frame includes a printing platen.

11. Apparatus as set forth in claim 1 wherein said aligning means comprises a first pawl and said locking means comprises a second pawl.

12. Apparatus as set forth in claim 11 wherein said rotatable indicia carrying member includes a plurality of spaced teeth, said rotating means including a rack operatively engaging said teeth, said rack including means defining a recess, and said first pawl being movably disposed in said recess when said frame is moved toward said locking position.

13. Apparatus as set forth in claim 12 wherein said first and second pawls each include distal end portions, said distal end portion of said first pawl being free to move within said recess as said frame is moved to said locking position and said distal end portion of said second pawl is brought into retentive engagement with said teeth.

14. Apparatus as set forth in claim 12 wherein said recess includes means defining an opening through which the first pawl passes as it moves into said recess, said teeth being similarly shaped and equidistantly spaced about the periphery of the rotatable member, the width of said opening being approximately equal to the equivalent angular distance between corresponding portions of adjacent teeth.

15. Apparatus as set forth in claim 13 wherein said second pawl includes means defining a pair of surfaces which when moved to said locking position are adapted to engage said teeth in such a manner as to exert equal and opposite moments on said indicia carrying member, thereby locking said member against rotational movement.

16. Apparatus as set forth in claim 15 wherein said recess includes means defining an opening through which the first pawl passes as it moves into said recess, said teeth being similarly shaped and equidistantly spaced about the periphery of the rotatable member, the width of said opening being approximately equal to the equivalent angular distance between corresponding portions of adjacent teeth.

17. Apparatus as set forth in claim 11 wherein said rotatable indicia carrying member includes means defining a plurality of spaced teeth, said rotating means including a rack adapted to engage said teeth, a camming surface formed in said rack, said first pawl upon movement of said frame toward said locking position operatively engaging said camming surface to actuate said rack to position said rotatable member in the desired position.

18. Apparatus as set forth in claim 11 wherein said frame and said first and second pawls are formed as a single molded member.

19. Apparatus as set forth in claim 1 wherein said frame movement means moves said frame between said locking and retracted position in a substantially linear manner.

20. Apparatus as set forth in claim 19 wherein said frame movement means moves said frame between said locking and retracted positions in a generally radial direction to said axis of rotation.

* * * * *